US005317838A

United States Patent [19]

Bourner

[11] Patent Number: 5,317,838

[45] Date of Patent: Jun. 7, 1994

[54] SANDING APPARATUS

[75] Inventor: Michael Bourner, Co. Durham, United Kingdom

[73] Assignee: Black & Decker Inc., Newark, Del.

[21] Appl. No.: 973,134

[22] Filed: Nov. 6, 1992

[30] Foreign Application Priority Data

Nov. 6, 1991 [GB] United Kingdom ..... 9123502

[51] Int. Cl.[5] ..... B24B 23/00

[52] U.S. Cl. ..... 51/170 R; 51/170 MT; 51/134.5 R

[58] Field of Search ..... 51/170 R, 170 T, 170 TL, 51/170 MT, 134.5 R, 134.5 F

[56] References Cited

U.S. PATENT DOCUMENTS

| | | | |
|---|---|---|---|
| 1,800,341 | 4/1931 | Davies . | |
| 3,785,092 | 1/1974 | Hutchins . | |
| 4,531,329 | 7/1985 | Huber . | |
| 4,660,329 | 4/1987 | Hutchins . | |
| 4,727,682 | 3/1988 | Stäbler et al. | 51/120 |
| 4,729,195 | 3/1988 | Berger | 51/170 MT |
| 4,754,575 | 7/1988 | Schneider | 51/120 |
| 4,759,152 | 7/1988 | Berger et al. | 51/120 |
| 4,839,995 | 6/1989 | Hutchins | 51/170 MT |
| 4,924,636 | 5/1990 | Hoffman | 51/170 MT |
| 5,018,314 | 5/1991 | Fushiya et al. | 51/170 MT |

FOREIGN PATENT DOCUMENTS

| | | |
|---|---|---|
| 0230621 | 8/1987 | European Pat. Off. . |
| 0254850 | 2/1988 | European Pat. Off. . |
| 0320599 | 6/1989 | European Pat. Off. . |
| 8804218 | 6/1988 | PCT Int'l Appl. . |
| 8909114 | 10/1989 | PCT Int'l Appl. . |
| 9009869 | 9/1990 | PCT Int'l Appl. . |

*Primary Examiner*—M. Rachuba

*Attorney, Agent, or Firm*—Dennis A. Dearing; John D. Del Ponti; Charles E. Yocum

[57] ABSTRACT

Sanding apparatus comprises a housing for a motor driving a drive spindle. A sanding disk platen is mounted on one end of the drive spindle through a freely rotatable bearing disposed eccentrically with respect to the drive spindle. A sanding disk is disposed on a front surface of the platen. A resiliently biased brake is mounted in the housing and is adapted to bear against a low friction annular surface of the platen in a direction substantially parallel to the axis of the drive spindle. The drive spindle is arranged to rotate at between 10,000 and 15,000 rpm. Under no load, the brake permits rotation of the platen about its own axis up to about 750 rpm.

13 Claims, 2 Drawing Sheets

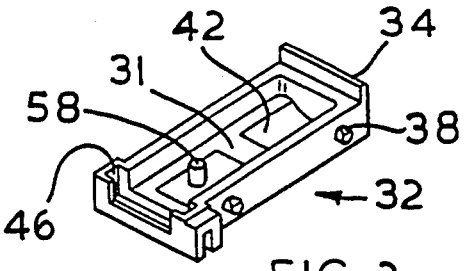
FIG. 2a
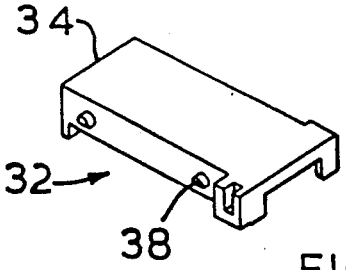
FIG. 2b
FIG. 2c
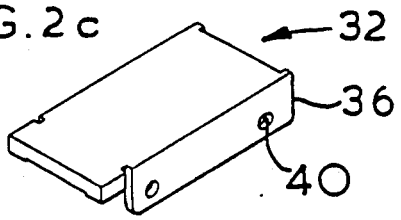
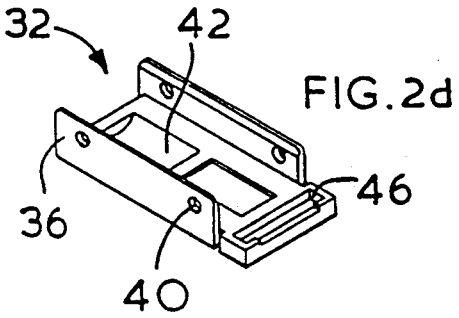
FIG. 2d
FIG. 2e
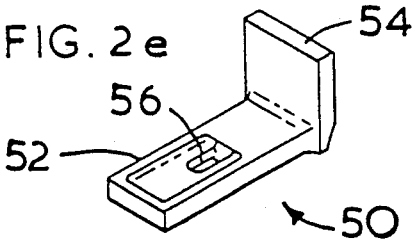
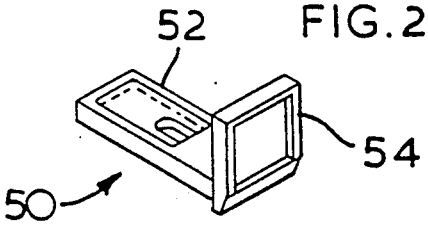
FIG. 2f
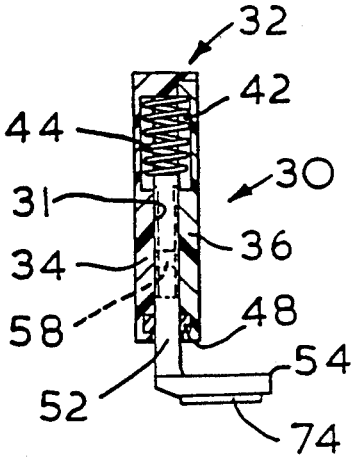
FIG. 3a
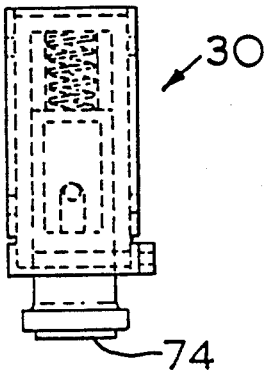
FIG. 3b
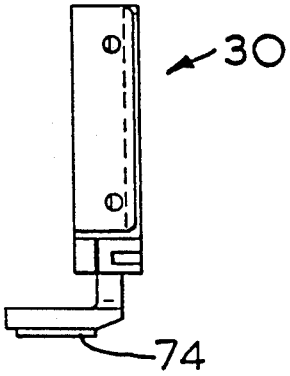
FIG. 3c

SANDING APPARATUS

FIELD OF THE INVENTION

This invention relates to apparatus of the type commonly referred to as random orbit sanders.

BACKGROUND OF THE INVENTION

The basic construction of these types of sanders, polishers and grinders is well known and comprises an essentially circular sanding disk or platen having a central mounting through a freely rotatable bearing eccentrically mounted on the end of a drive spindle.

Rotation of the drive spindle causes the sanding disk to orbit about the drive spindle. When no external forces act on the disk, the inherent friction in the bearing results in the disk tending to rotate about the spindle axis at full spindle rotation speed. On the other hand, when light pressure is applied to the sanding disk, rotation of the disk can be prevented and the disk merely orbits, as, for example, in a conventional orbit sanding machine.

However, when the sanding disk is pressed onto a workpiece surface, the frictional contact between the pad and workpiece results in a movement of the pad in which it rotates at some considerably lesser speed than the spindle rotation rate, and usually in the opposite direction to the spindle rotation. It also, of course, orbits. This has been found to be a very useful sanding movement and since it has the appearance of being somewhat random, this is the reason for the term "random orbit" as applied to this type of machine.

However, a problem with such machines is that, when there are no external forces acting on the sanding disk and it rotates at full spindle speed, the operator has to be extremely careful when applying the disk to a workpiece, otherwise the inertia of the disk will result in a deep gouge being cut in the workpiece before the disk settles into its, far less aggressive, random orbit movement. One way out of this problem is to apply the sanding disk to the work surface before switching on the sander and so that it never has the opportunity to work up to full rotational speed. However, most users have an instinctive reluctance to do this on the premise (which is untrue in this somewhat unique case) that one should never engage a machine with its load before it has reached its operating speed.

Numerous patents relating to this type of sander address this problem. Most solve it by providing a planetary gear type arrangement between the sanding disk and a housing for the drive spindle. The gear on the disk meshes with that on the housing so that orbiting of the disk results in its gear running around the gear in the housing so that the disk rotates, in the reverse direction with respect to that of the drive spindle, with a speed determined by the-geometry of the gears and eccentricity of the bearing. Examples of such patents are U.S. Pat. No. 4,754,575, WO-A-8909114, U.S. Pat. No. 4,759,152, U.S. Pat. No. 4,727,682, WO-A-8804218, WO-A-9009869, EP-A-0230621, EP-A-0254850 and EP-A-0320599.

The last two differ from the remainder in that EP-A-0254850 employs a rubber friction ring on the disk which can be engaged with a rolling surface on the housing so that only friction, rather than meshing gear teeth, provides the contact between the two. In EP-A-0320599 there is optional physical contact between the gear rings but, when these are not meshed, a magnetic coupling between the disk and housing prevents unconstrained rotation of the disk.

However, all these systems are somewhat complicated and costly to provide and, (with the exception of EP-A-0245850 and EP-A-0230599) essentially destroy the random movement of the sanding disk which characterise the nature of these types of sanding machine. Instead these systems all constrain the sanding disk platen to rotate with fixed speed and direction.

In another prior art patent U.S. Pat. No. 5,018,314 a leaf spring is mounted on the rear bottom edge of the housing and is arranged to contact the edge of the platen as it orbits. In so contacting the edge (at least once, and for at least a part of, each orbit), it has the effect of reducing the rotational speed of the platen. In fact, from an armature speed of 12,000 rpm this arrangement is said to reduce the speed to 1500 rpm. This approach also suffers a number of disadvantages.

If the leaf spring only contacts the platen briefly during each spindle rotation, as described in U.S. Pat. No. 5018314, undesirable vibration can set in. Moreover, the platen tends to accelerate while not contacted and decelerate while contacted by the leaf spring and this results in an erratic movement of the platen. Secondly, although 1500 rpm is sufficiently slow to remove the gouging problem referred to above, nevertheless the platen still seems to be rotating fast, and, of course, half the problem is in satisfying the user that the problem is solved and with this arrangement this aspect is not achieved. Thirdly, the leaf spring contacts the flexible elastomeric surface of the sanding platen and, particularly with the intermittent contact made by the leaf spring, wear of the contact surface is inevitable. Fourthly, with an armature speed of the order of 12,000 rpm, the platen moves back and forth 12,000 times a minute, regardless of how fast it actually rotates, and it is doubtful that the leaf spring can move at this rate to maintain contact with the edge of the platen.

SUMMARY OF THE INVENTION

It is an object of the present invention to solve the problem of free rotation of the grinding disks in such machines in a simple way, without destroying the essentially random nature of their disk movement and without incurring the problems outlined above, or at least mitigating their effects.

Thus in accordance with the present invention there is provided sanding apparatus comprising a housing containing a drive spindle arranged to rotate in the housing; a sanding disk platen mounted on one end of the drive spindle through a freely rotatable bearing disposed eccentrically with respect to the drive spindle, the platen having substantially flat, parallel front and rear surfaces lying substantially perpendicular to the spindle axis; a sanding disk being adapted to be disposed on said front surface of the platen; a low friction annular surface being disposed on said rear surface about said bearing; and a resiliently biased brake being mounted in said housing and adapted to bear against said annular surface in a direction substantially parallel to said spindle axis.

The frictional forces between the bearing and platen (hereinafter referred to as "the bearing forces") and which ultimately cause rotation of the disk platen with the drive spindle under no-load conditions, are several orders of magnitude less than the frictional forces between the workpiece and platen (hereinafter referred to as "the workpiece forces") and which dictate a different rotational regime for the platen with respect to the drive spindle under load conditions. Thus under load conditions, the workpiece forces totally overcome the bearing forces. The brake exerts a further force on the platen (hereinafter referred to as "the braking forces") and this force is arranged to be of a level between the bearing and workpiece forces. Thus under no load conditions, the braking force overcomes the bearing force and reduces the tendency of the platen to rotate. Preferably it is arranged to reduce rotation of the platen, when the drive spindle rotates at a rate of between 10,000 and 15,000 rpm, to below 750 rpm under these conditions, and preferably below 400 rpm. On the other hand, however, the braking force is arranged to be much less than the workpiece forces so that the latter easily overcome the braking force under load conditions. In this event, the platen rotates in substantially the same way it would do if the brake was omitted.

The platen moves in a plane perpendicular to the spindle axis as it rotates and orbits. Since the brake acts in a direction substantially perpendicular to the platen plane and acts on the annular surface which is substantially in that plane, and, moreover, is urged permanently into contact with said surface, there is little or no extra vibration introduced by the brake. That is to say, the brake itself does not vibrate.

Moreover said annular surface is preferably a steel backing plate for the platen and the brake is made from low friction material so that it slides over said surface with little heat generation or wear.

Preferably said brake is a finger brake and comprises a body mounted in the housing; a finger slidable in the body; and a spring disposed between said body and a stem of said finger.

Preferably said body comprises two shells clamped together, means being provided to retain said stem between the shells. Said means may comprise a lug on one or both shells adapted to engage a slot in said stem.

A switch may be disposed in the housing by means of which the brake pad can be disengaged from the platen. Such an arrangement may be desirable in cases where the braking force is sufficient to affect materially the rotational regime of the platen under the influence of the workpiece forces.

BRIEF DESCRIPTION OF THE DRAWINGS

The invention is further described hereinafter, by way of example only, with reference to the accompanying drawings, in which:

FIGS. 2*a* to *f* are perspective views of parts comprising a finger brake according to the invention; and FIGS. 3*a* to *c* are sectional, front and side views respectively of the finger brake shown in FIG. 2.

DETAILED DESCRIPTION OF THE PREFERRED EMBODIMENTS

Figure 1:
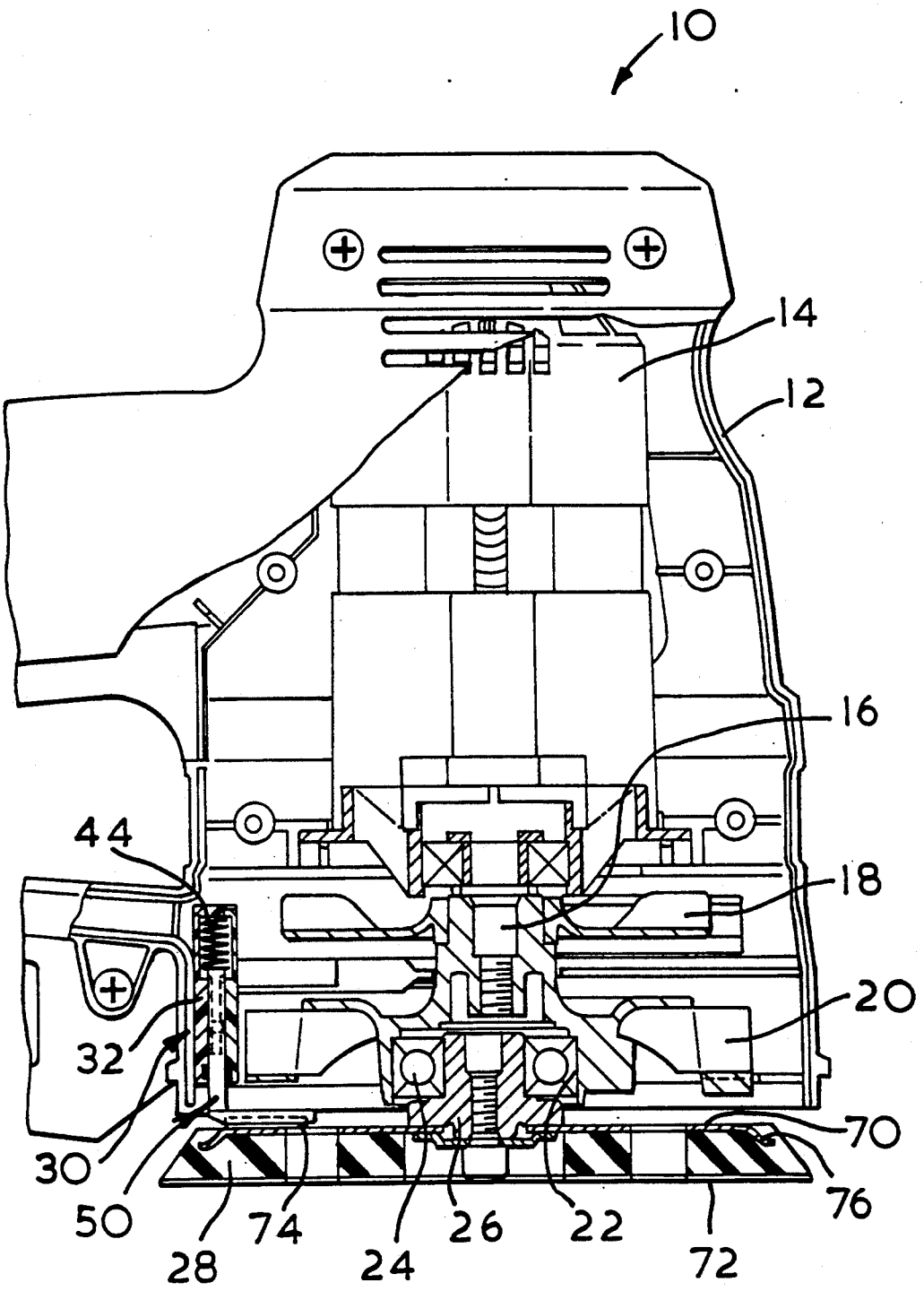
FIG. 1 is a side view, partly in section, of sanding apparatus according to the invention.

In FIG. 1 of the drawings, a random orbit sander 10 comprises a housing 12 of two clam-shell-type halves, only one half being shown.

Seated in the housing 12 is a motor 14 whose output shaft or drive spindle 16 mounts a motor cooling fan 18 and dust extraction fan 20.

The fan 20 has an eccentric recess 22 which receives a bearing 24 in which is journalled an arbor 26. On the arbor 26 is mounted a platen 28 to which abrasive sheets are adapted to be secured.

Rotation of the drive spindle 16 causes the platen to orbit about the central axis of the shaft 16. If no load is applied to the platen 28, the frictional contact in the bearing 24 tends to transmit rotational forces to the arbor 26 and platen 28 so that after a short time (two or three seconds) after starting the motor 14, the platen tends to rotate with the drive spindle 16 at full motor speed which may be of the order of 12,000 rpm.

In order to prevent this from happening, or at least to slow the platen to more manageable speeds such as 400 rpm, a finger brake 30 is provided.

Referring to FIGS. 2 and 3, the finger brake comprises a body 32 in two parts, a shell 34 and a cover 36, adapted to be clipped together by mutually engaging lugs 38 and holes 40.

Between the two parts 34, 36 is defined a spring chamber 42 (adapted to receive a spring 44) and a seal chamber 46, adapted to receive a seal 48. A finger 50 is slidably received in the body 32, the finger having a stem 52 and pad receptor 54. The stem 52 has an aperture 56 adapted to co-operate with a lug 58 formed in a floor 31 of the shell 34.

Assembly of the finger brake 30 is carried out as follows:

The stem 52 of the finger 50 is first passed through a central aperture of the seal 48. The spring 44 is then placed in the spring chamber 42 of the shell 34. The stem is then placed in the shell 34 engaging its end with the spring 44, compressing it slightly. The aperture 56 is engaged with the lug 58 and the seal 48 is engaged in the seal chamber 46 in the shell 34. Finally the cover 36 is snapped into engagement with the shell 34. The assembled finger brake 30 is shown in FIG. 3 where it can be seen that the lug 58 retains the stem 52 in the body 32. Moreover it will be appreciated that the spring 44 is pretensioned during assembly and acts to urge the stem 52 axially out of the body. The finger 50 can of course be pushed further into the body against the spring bias.

Returning to FIG. 1, the platen 28 comprises a steel backing disk forming a rear annular surface 70 of the platen. A front surface 72 of the platen is formed from an elastomeric material moulded onto the steel backing disk 70. The front surface may be provided with a hooked nylon coating by which to grip abrasive disk sheets provided with a fabric pile.

The body 32 of the finger brake 30 is inserted in a socket (not shown) in the clam-shell half of the housing 12, the finger 50 being free to move. The pad-receptor 54 of the finger 50 is provided with a pad 74 of low friction material such as polytetrafluoroethylene (PTFE). This pad 74 is pressed against the surface 70 of the platen 28 when the latter is connected (after final assembly of the housing 12) to the arbor 26. Such connection further compresses the spring 44. Thus the pad 74 is pressed against the rear surface 70 of the platen and brakes it against movement.

However, the pad is low friction material and the surface 70 over which it acts is primarily smooth steel. Thus there is very little grip or frictional contact between the pad 74 and surface 70. However, by suitable choice of the respective materials and the pressure exerted by the spring 44, the frictional contact can be arranged sufficient to prevent the platen 28 from rotating about its own axis when no other load is applied and the motor 14 runs at full speed (e.g. 12,000 rpm). A spring force of between four and seven Newtons has been found to give adequate results. Varying the pad size does not affect the braking efficiency to any great extent, but, if it is large, wear of the pad is minimised and irregularities of the platen surface have less effect on the braking action. A pad size of 15 millimeters square has been found acceptable in this regard. Some rotation of the platen is desirable to reduce the load on the motor which would be excessive for nominal no-load conditions if the brake was sufficiently strong to prevent any rotation. This is because there is always movement of the platen 28 under the brake 30 whether or not there is rotation of the platen; the platen must at least orbit about the axis of the shaft 16. Thus the brake would have robe very strong, and hence a significant load would be placed on the motor 14, in order to prevent any rotation of the platen.

Indeed, the load that is placed on the motor is primarily through the friction of the bearing 24 which, if the platen 28 rotates only slowly, has its inner and outer races moving at high speed with respect to one another. This load is in any event normally imposed on the motor when the platen is slowed by its contact with a work piece. Consequently the load imposed by the brake when the sander is in use is quite negligible and hence there is no requirement to disengage the brake during normal sanding operation.

Nevertheless, whatever load is applied by the brake and however effective it is, there is little or no vibration caused by the presence of the brake. The brake itself does not move except to take up any irregularities in the surface 70. Moreover, because it acts on a smooth steel surface and comprises a low friction material, not only is there little noticeable load imposed on the motor by the brake, but also there is no significant wear of the brake parts and particularly not of the platen or its elastomeric material. The pad 74 does run over the elastomeric material at the edge 76 of the metal disk where the disk is deflected downwardly to enter the elastic material so as to bind together more effectively the disk and elastomer material. Nevertheless, the pad 74 always maintains contact with the steel disk 70 and so cannot wear the elastomeric material to any significant extent.

When the sander 10 is applied to a workpiece (not shown) the frictional contact between the workpiece and sanding disk (not shown) on the platen surface 72 overcomes the braking effect of the pad 74. The platen rotates in much the same way as it would if the brake was omitted. That is to say, the brake 30 has no noticeable effect on the random orbit/rotational movement of the disk. Moreover, the brake appears not to increase to any significant extent the load applied to the motor under normal operating conditions. However, it is appreciated that it may be deemed desirable to give the brake sufficient braking power that the rotational regime of the platen under load conditions is still effected by the brake. In these circumstances it may also be deemed desirable to provide means to disengage the brake.

What is claimed is:

1. Sanding apparatus comprising a housing a drive spindle arranged to rotate in the housing; a sanding disk platen mounted on one end of the drive spindle through a freely rotatable bearing disposed eccentrically with respect to the drive spindle, the platen having substantially flat, parallel front and rear surfaces lying substantially perpendicular to the spindle axis; a sanding disk being adapted to be disposed on said front surface of the platen; a low friction annular surface being disposed on said rear surface about said bearing; and a resiliently biased finger brake being mounted in said housing and adapted to bear against said annular surface in a direction substantially parallel to said spindle axis, the brake comprising a body mounted on the housing, a finger slidable in the body, and a spring disposed between said body and a stem of said finger.

2. Sanding apparatus according to claim 1, wherein braking forces between the brake and the platen are intermediate (a) bearing forces between the spindle and the platen and (b) workpiece forces between the platen and a workpiece engaged by said platen when said sanding disk is disposed on the platen.

3. Sanding apparatus according to claim 2, wherein the drive spindle is arranged to rotate at between 10,000 and 15,000 rpm and the brake permits rotation of the platen about its own axis up to 750 rpm.

4. Sanding apparatus according to claim 1, wherein said annular surface is a steel backing plate of the platen and the brake is made from low friction material.

5. Sanding apparatus according to claim 4, wherein said low friction material is polytetrafluoroethylene (PTFE).

6. Sanding apparatus according to claim 1, wherein said body comprises two shells clamped together, means being provided to retain said stem between the shells.

7. Sanding apparatus according to claim 6, wherein said means comprises a lug on one or both shells adapted to engage a slot in said stem.

8. A random orbit sander comprising:

a housing;

a drive spindle having a longitudinal axis and rotatably mounted in the housing;

a sanding disc platen mounted on one end of the drive spindle;

a freely rotatable bearing disposed eccentrically with respect to the drive spindle and rotatably supporting the platen;

the platen having substantially flat, parallel front and rear surfaces lying substantially perpendicular to the spindle axis;

the platen front surface adapted to receive a sanding disk;

a low friction annular surface being disposed on the rear platen surface about the bearing; and a finger brake mounted in the housing and resiliently biased in a direction substantially parallel to the spindle axis into engagement with the annular surface, whereby the finger brake continuously slideably engages portions of the annular surface lying in a plane perpendicular to the spindle axis when the platen is rotatably driven.

9. The sander of claim 8, wherein said annular surface is a steel backing plate of the platen and the brake is made from low friction material.

10. The sander of claim 9, wherein said low friction material is polytetrafluoroethylene (PTFE).

11. The sander of claim 8, wherein the finger brake comprises a body mounted in the housing; a finer slidable in the body; and a spring disposed between said body and a stem of said finger.

12. The sander of claim 11, wherein said body comprises two shells clamped together, and the brake comprises means for retaining said stem between the shells.

13. The sander of claim 12, wherein said retaining means comprises a lug on one or both shells engaged in a slot in said stem.

* * * * *